US006636155B2

(12) United States Patent
Elizondo-Salinas

(10) Patent No.: US 6,636,155 B2
(45) Date of Patent: Oct. 21, 2003

(54) GAUGE HAVING ADJUSTABLE ACTIVATING MEANS

(75) Inventor: Jesús-Gerardo Elizondo-Salinas, Guadalupe (MX)

(73) Assignee: Prolec G.E. S De R.L. De C.V., Nuevo Leon (MX)

( * ) Notice: Subject to any disclaimer, the term of this patent is extended or adjusted under 35 U.S.C. 154(b) by 65 days.

(21) Appl. No.: 09/682,882

(22) Filed: Oct. 29, 2001

(65) Prior Publication Data

US 2003/0080873 A1 May 1, 2003

(51) Int. Cl.[7] ..... G08B 5/00; G08B 5/24

(52) U.S. Cl. ..... 340/815.4; 340/815.78; 340/815.86; 340/451; 340/525; 340/626; 340/688; 340/678; 340/611; 340/614; 73/732; 73/733; 73/865.1; 137/554; 137/557; 137/556.3; 116/270; 116/284; 307/118

(58) Field of Search ..... 340/815.4, 815.78, 340/815.8, 815.86, 450, 451, 501, 525, 626, 688, 611, 614, 678; 73/732, 741, 733, 756, 700, 749, 865.1; 137/533, 554, 557, 556.3; 116/70, 270, 284; 307/118

(56) References Cited

U.S. PATENT DOCUMENTS

| | | | | | |
|---|---|---|---|---|---|
| 4,613,851 | A | * | 9/1986 | Hines | 340/688 |
| 4,906,977 | A | | 3/1990 | Huey-Jeng | 340/626 |
| 5,121,109 | A | * | 6/1992 | Murphy, Jr. et al. | 340/688 |
| 5,357,242 | A | | 10/1994 | Morgano et al. | 340/626 |
| 5,796,343 | A | * | 8/1998 | Stauder | 340/626 |

* cited by examiner

*Primary Examiner*—Donnie L. Crosland
(74) *Attorney, Agent, or Firm*—Jay R. Yablon

(57) ABSTRACT

A mechanical gauge having a mechanism for setting multiple alarms within tolerance values. When such tolerance values defined by the mechanism are reached, the same mechanism activates an alarm.

11 Claims, 2 Drawing Sheets

GAUGE HAVING ADJUSTABLE ACTIVATING MEANS

BACKGROUND OF INVENTION

The present invention is related to pressure and level gauges, and more particularly to a gauge having adjustable activating means by which multiple "alarm points" may be set for activating an alarm device.

There are well known the pressure and fluid level gauges for providing information about oil level or pressure level.

Said pressure and level gauges normally comprise a gauge movement responsive to a sensed condition, which moves an indicator needle for indicating said sensed condition over a scale dial.

Some gauges include adjustable activating alarm means for setting an alarm to be activated at a predetermined sensed value.

A gauge having adjustable activating alarm means is disclosed in the U.S. Pat. No. 4,906,977 which claims: "a pressure gauge having a turning button, a turning semi-disc and a sliding block disposed thereon that, through a protruding wheel fixed on the needle shaft moves the sliding block to force a contact point of a conducting metal piece to contact with a contact point of the turning semi-disc, can start an alarm in case the needle of the gauge comes to reach the designated pressure".

With the above referred gauge the user is able to set only one "alarm point", therefore, the user can't set several "alarm points" at various pressure values at the same time.

Another gauge having adjustable activating alarm means is disclosed in the U.S. Pat. No. 5,357,242 which claims "a diver's air tank pressure gauge having audible and visual alarms, an alarm pointer for indicating the pressure at which the alarms will activate, and a crank assembly for changing the position of the alarm pointer. The pressure gauge dial has a cutout for limiting the travel of the alarm pointer between acceptable high and low pressure limits. When the air tank pressure equals a preset alarm pressure, an electrical circuit is completed which activates the alarms. The diver can then turn off the alarms by resetting the alarm indicator to a lower pressure setting and continue the dive at a shallower depth".

With the above referred gauge it is possible to set only one alarm point corresponding to one predetermined pressure value, therefore, in order to set the alarm to a second pressure value, it is necessary to reset the alarm indicator.

Therefore, it would be highly desirable to have a gauge in which multiple "alarm points" may be set, which is useful to set "tolerance value regions" between lower and upper limits in the scale dial values.

SUMMARY OF INVENTION

In view of the above referred needs, applicants developed a gauge having adjustable activating means—for activating, say an alarm—in which multiple alarm points—or tolerance value regions—can be set.

Applicants gauge having adjustable activating means comprises: a movement case including a front open portion and a back portion, a gauge movement responsive to a sensed condition located inside the case and driving a rotary gauge shaft and an indicator needle indicating said sensed condition on a scale dial, wherein the adjustable activating means comprising: a plurality of at least two rotating adjusting guides mounted on the rotary gauge shaft; activating means attached to each adjusting guide; bump means for each rotating adjusting guide, said bump mean restricting the rotation of each adjusting guide thus defining a limited rotation arc thereof which is representative of a predetermined range in a scale dial; cam means coupled to the rotary gauge shaft close to the plurality of adjusting guides, said cam means rotating together with the rotary gauge shaft and defining a circular path as the rotary gauge shaft rotates, therefore, when the cam means make contact with one of the activating means of an adjusting guide, sad activating means send and electric signal to the alarm means, thus activating said alarm to inform an operator that a measurement value has been achieved, said value defined by the position of an adjusting guide.

With the use of the rotating adjusting guides, it is possible to set multiple "alarm points" in order to activate an alarm, for example, without using complicated mechanisms.

With applicant's gauge, any user is allowed to set a plurality of "alarm points" or the limits of a "tolerance value region" between lower and upper limits—for example oil level or temperature—at which a device can operate safely.

Furthermore, the activating means may activate not only an alarm device, but any other device such as an electronic control which can send signals representative of corrective actions or adjustments to the controlled device in order to return the sensed conditions to the "tolerance value region".

Finally, applicants gauge can be adapted to sense many conditions such a as pressure, liquid levels etc., without needing important modifications in its movement and mechanism except for the scale dial.

It is therefore a main objective of the present invention, to provide a gauge having adjustable activating means which allows an user to set a plurality of "alarm points" or the limits of a "tolerance value region" between lower and upper limits.

It is another objective of the present invention, to provide a gauge having adjustable activating means of the above disclosed nature, wherein the activating means may activate an alarm or any other device such as an electronic control which can send signals representative of corrective actions or adjustments to the controlled device in order to return the sensed conditions to the "tolerance value region".

It is a further objective of the present invention, to provide a gauge having adjustable activating means of the above disclosed nature, which allows an user to set a plurality of "alarm points" or the limits of a "tolerance value region" between lower and upper limits without the use of complicated mechanisms.

It is still another main objective of the present invention to provide a gauge having adjustable activating means of the above disclosed nature, which can be adapted to sense many conditions such a as pressure, liquid levels etc., without needing important modifications in its movement and/or mechanisms except for the scale dial.

These and other objects and advantages of the gauge having adjustable activating means of the present invention will become apparent to those persons having an ordinary skill in the art, from the following detailed description of the invention which will be made with reference to the accompanying drawings.

BRIEF DESCRIPTION OF DRAWINGS

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION

Figure 1:
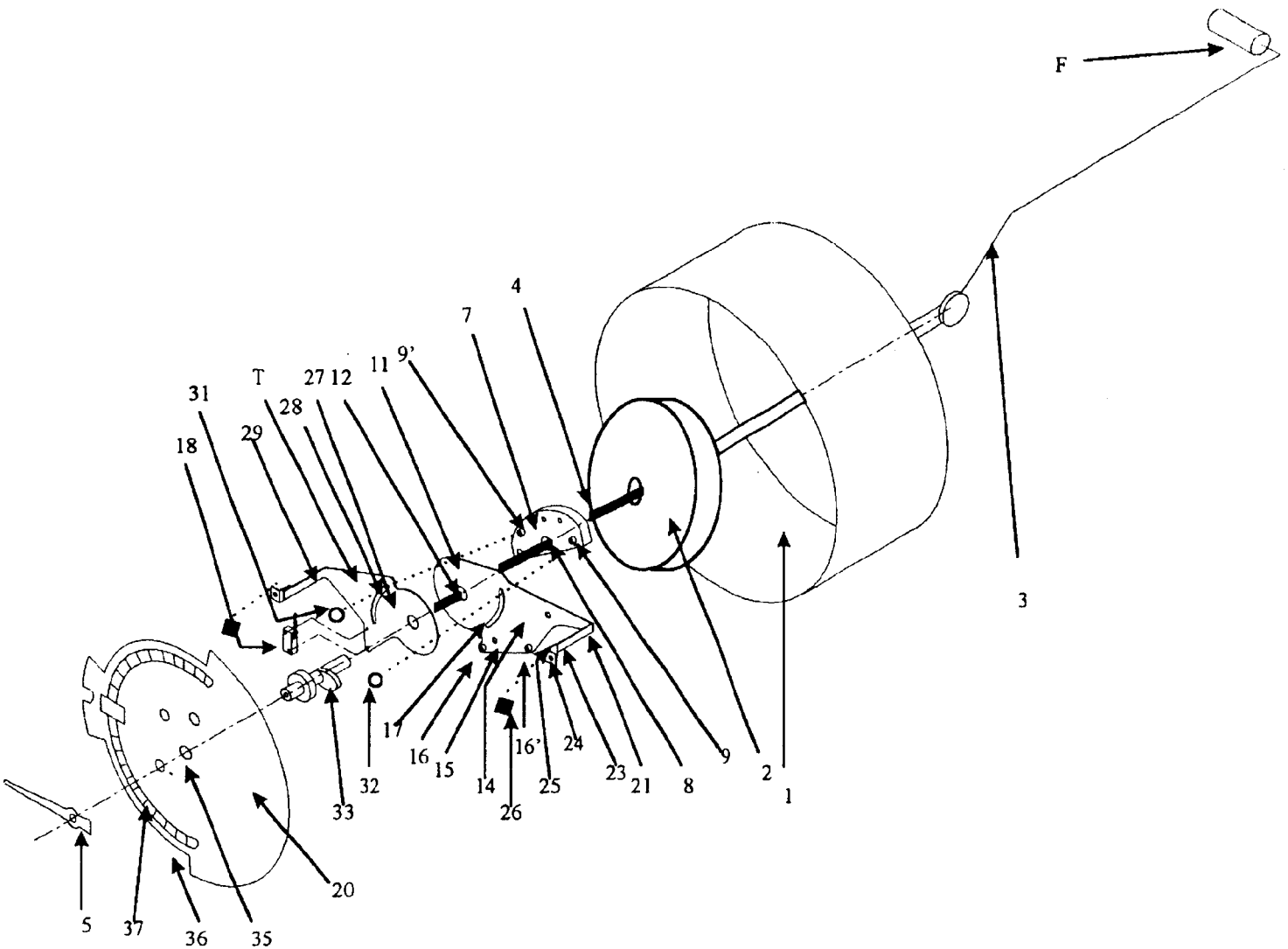
FIG. 1 is an exploded perspective view of the gauge of the present invention having adjustable activating means of the present invention.
Figure 2:
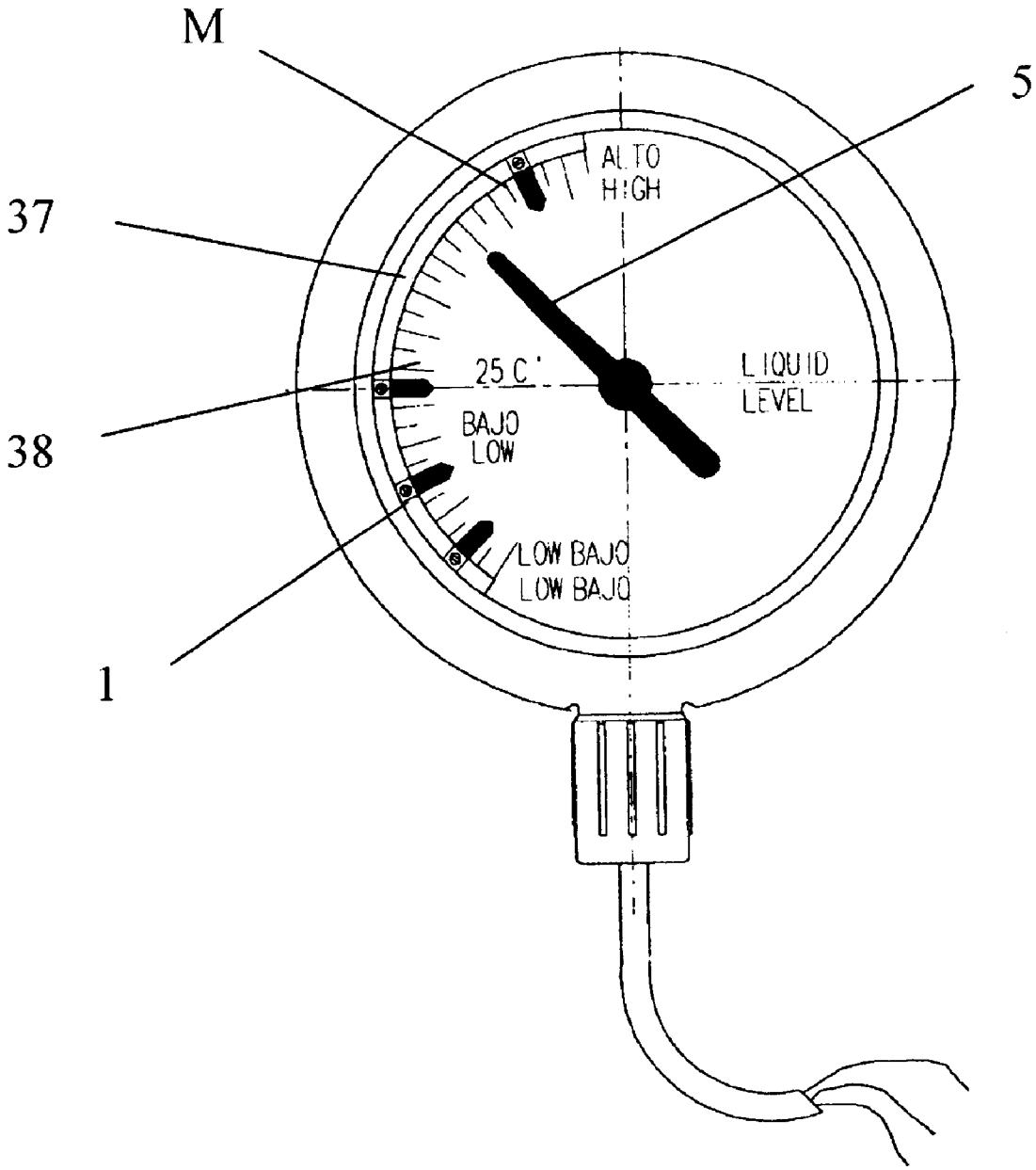
FIG. 2 is a front view of the gauge of the present invention showing the scale dial.

The invention will be described in accordance with a preferred embodiment thereof, making reference to a level oil gauge for an electric transformer, illustrated in the accompanying drawings wherein the same signs and numbers, refer to the same parts of the shown figures, the gauge having adjustable activating means of the present invention comprising:

a circular movement case including a front open portion 1 and a back portion (not shown);

a gauge movement 2 responsive to a sensed oil level value, located at the back portion of the movement case and linked to a rod 3 connected to a float "F" located in a fluid tank (not shown), said gauge movement 2 driving a rotary gauge shaft 4 which in turn moves an indicator needle 5 joined to an end of the rotary gauge 4 shaft for indicating a sensed oil level;

adjustable activator means comprising:

a solid semi-disc having a front face 7 and a rear face (not shown), including a central perforation 8 to allow the pass of the rotary gauge shaft 4, and a first and a second laterally opposed bump means 9, 9' comprising a pair of bolts joined to the front face of the solid semi-disc, each bump mean 9, 9' having a central perforation (not shown) including an internal thread, and said solid semi-disc being fixedly coupled to the movement case by means of a plurality of screws (not shown) to prevent the rotation thereof and located next to the gauge movement 2;

a first adjusting guide, including:

an elongated asymmetric planar portion having a circular end portion 11 including a perforation 12 to allow the pass of the rotary gauge shaft 13, a triangular end portion 14 opposed to the circular end portion 11, a triangular lateral section 15 including two perforations 16, 16' located laterally to the portions 11 and 14, a semi-circular slot 17 located at the center of the planar portion between the circular end portion 11 and the triangular end portion 14 and being concentric with respect to the circular movement case, said slot 17 having the sufficient width to allow the pass of the first bump means 9, 9'; switch means 18 connected to alarm means (not shown) and attached to the triangular lateral section 15 by means of two screws (not shown) passing trough perforations 16, 16' and facing the circular scale dial 20, said semicircular slot 17 having sufficient width to allow the pass of the bump means 9, 9', said asymmetric planar portion mounted on the rotary gauge shaft 13 next to the solid semi-disc, and freely rotating on the shaft 13 but independently of the rotation thereof;

an elongated lever having a first end 22 perpendicularly joined to the triangular end portion 14 of the asymmetric planar portion at a right angle with respect to the surface of the asymmetric planar portion, and having a second end 23 coupling a metallic support comprising a "L" shaped metallic piece 24 defining an indicator receiving surface 25 facing the front open portion 1 of the circular movement case, the elongated lever allowing to easily rotate the asymmetric planar portion, and said indicator receiving surface 25 attaching a plastic indicator 26;

said first bump means 9 restricting the travel of the first adjusting guide, thus defining a limited rotation arc which is representative of a predetermined "minimum value region" "I" of the gauge measurement scale;

a second adjusting guide 27 having the same characteristics of the first adjusting guide, mounted on the rotary gauge shaft 13 next to the first adjusting guide, and freely rotating on the shaft 13 but independently of the rotation thereof, and its semicircular slot 28 allowing the pass of the second bump means 9'. The elongated lever 29 of the second adjusting guide 27 normally remaining opposed to the elongated lever of the first adjusting guide and said second bump means 9' restricting the travel of the second adjusting guide 27 thus defining a rotation arc which is representative of a predetermined "maximum range" "M" of the gauge measurement scale, and the triangular lateral section "T" of the second adjusting guide 27, attaching switch means "S" by means of two bolt-screw assemblies (not shown);

securing means for each adjusting guide comprising: a first screw 31, passing trough the semicircular slot 17 of the first adjusting guide and threaded inside the perforation 16 of the first bump means 9 and a second screw 32 passing trough the semicircular slot 28 of the second adjusting guide 27 and threaded inside the perforation 6' of the second bump means 9', said first and second screws 31, 32 applying a pressure to the first and second adjusting guides respectively against the bump means 9, 9' but not restricting the rotation of the adjusting guides in order to secure them in a predetermined position;

cam means 33 coupled to the rotary gauge shaft 13 next to the second adjusting guide 27, said cam means 33 defining a circular path as the rotary gauge shaft 13 rotates. The run of said path is normally limited between the switch means 18 of the first and second adjusting guides;

said circular scale dial 20 attached to the movement case at its front open portion 1, and having a central perforation 35 to allow the pass of an end of the rotary gauge shaft 13 and having a semicircular slot 36 allowing the pass of the "L" shaped metallic support 24 of both adjusting guides, said semicircular slot defining a "scale adjusting zone" 37, and said scale dial 20 representing different values of the oil level of a transformer (not shown).

A user can rotate one or both adjusting guides in order to define a threshold-between the maximum range "M" i.e. a maximum oil level defined by the first adjusting guide and the minimum range "I" i.e. a minimum oil level defined by the second adjusting guide, 27, with the aid of the first and second adjusting guide indicators 26, 26', and the marks 38 of the circular scale dial.

Once a threshold is defined, when the cam means 33, rotating together with the rotary gauge shaft 13, approaches to a maximum "M" or minimum "I" tolerance value, the cam means 33 make contact with one of the switch means 18 of an adjusting guide, which send and electric signal to an alarm, thus activating said alarm to inform an operator that a minimum "I" or maximum "M" transformer oil level condition has been reached, and that a corrective action must be taken in order to avoid the damage of the transformer.

Also, the switch means 18 may send an electric signal to an electronic control (not shown), which may take any corrective action—such as adding oil to the transformer oil container in case of a "low oil level alarm" or draining oil from the transformer oil container in case of a "high oil level alarm"—.

Although in the preferred embodiment, the present invention was described making reference to an oil gauge for the measurement of the oil level of a transformer oil tank, it has to be understood that the gauge having an adjustable activator of the present invention may be adapted to any kind of device in order to sense and/or control the level of any kind of liquid or fluid, pressure levels etc. by adapting a suitable gauge movement depending on the condition to be sensed in order to drive the rotary shaft gauge, and by adapting a suitable scale dial.

And although the present invention was described having only two adjusting guides defining a threshold, it may have a plurality of additional adjusting guides for setting multiple "alarm points", thus when the cam means 33 make contact with the switch means 18 of each adjusting guide, an alarm or electronic control may be activated for each "alarm point".

Finally it must be understood that the gauge having an adjustable activator of the present invention, is not limited exclusively to the above described and illustrated embodiments and that the persons having ordinary skill in the art can, with the teaching provided by this invention, make modifications to the design, or component distribution of the gauge having an adjustable activator of the present invention, which will clearly be within the true inventive concept and scope of the invention which is claimed in the following claims.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A gauge having adjustable activating means for activating an alarm comprising a movement case including a front open portion and a back portion, a gauge movement responsive to a sensed condition located inside the case and driving a rotary gauge shaft and an indicator needle indicating said sensed condition on a scale dial, wherein the adjustable activating means comprising:

a plurality of at least two rotating adjusting guides having a lever portion, each adjusting guide mounted on the rotary shaft one before the other and freely rotating on the shaft, said lever portion allowing to easily rotate an adjusting guide from the front of the movement case, and said rotating adjusting guides defining one or more thresholds;

sensor means connected to an alarm, said sensor means attached to each rotating adjusting guide, for activating said alarm;

securing means for each adjusting guide for applying a pressure to an adjusting guide but not restricting the rotation thereof in order to secure an adjusting guide in a predetermined position;

bump means for each rotating adjusting guide, said bump means restricting the rotation of each adjusting guide thus defining a limited rotation arc which is representative of a predetermined range of a scale dial;

activating means for activating said alarm coupled to the rotary gauge shaft and located close to the plurality of adjusting guides, said activating means rotating together with the rotary gauge shaft and defining a circular path as the rotary gauge shaft rotates until the activating means make contact with one of the sensor means which send a signal to the alarm; and said scale dial attached to the movement case at its front open portion, and having a central perforation to allow the pass of an end of the rotary gauge shaft and having an semicircular slot allowing the pass of the lever portions of the plurality of adjusting guides, said semicircular slot defining a "scale adjusting zone" and said scale dial representing different values of a predetermined scale.

2. A gauge having adjustable activating means according to claim 1, wherein each rotating adjusting guide includes a first and a second end, a planar portion having a perforation to allow the pass of the rotary gauge shaft and a planar receiving section, and having an elongated lever portion joined to the second end of the planar portion including an indicator receiving surface attaching position indicator means, each rotating adjusting guide mounted on the rotary shaft one before the other and freely rotating on the shaft, said lever portion allowing to easily rotate an adjusting guide from the front of the movement case, and said rotating adjusting guides defining one or more thresholds.

3. A gauge having adjustable activating means according to claim 2, wherein the sensor means are attached to the planar receiving section of each rotating adjusting guide.

4. A gauge having adjustable activating means according to claim 1 wherein the activating means comprising cam means coupled to the rotary gauge shaft and located close to the plurality of adjusting guides, said cam means rotating together with the rotary gauge shaft and defining a circular path as the rotary gauge shaft rotates, until the cam means make contact with one of the sensor means which send a signal to the alarm, thus activating said alarm.

5. A gauge having adjustable activating means according to claim 1, in which the planar portion of each rotating adjusting guide includes a first and a second end, an elongated asymmetric planar portion having a circular end portion including a perforation to allow the pass of the rotary gauge shaft, a triangular end portion opposed to the circular end portion, a triangular lateral section including two perforations, a semi-circular slot located at the center of the planar portion between the circular end portion and the triangular end portion and being concentric with respect to the circular movement case, said slot having the sufficient width to allow the pass of the bump means.

6. A gauge having adjustable activating means according to claim 5, wherein the sensor means are attached to the triangular lateral section by means of two screws passing trough perforations thereof.

7. A gauge having adjustable activating means according to claim 5, wherein the elongated lever portion has a first end perpendicularly joined to the planar portion at a right angle with respect to the surface of the planar member, and having a second end coupling a metallic support comprising a "L" shaped metallic piece defining an indicator receiving surface facing to the front open portion of the circular movement case.

8. A gauge having adjustable activating means according to claim 1, wherein the bump means for each rotating adjusting guide comprise a bolt passing trough the semicircular slot of the planar portion and joined to the front face of a solid semi-disc fixedly coupled to back portion of the movement case by means of a plurality of screws to prevent the rotation thereof, each bump means having a central perforation including an internal thread.

9. A gauge having adjustable activating means according to claim 1, wherein the bump means for each rotating adjusting guide comprise a bolt passing trough the semicircular slot of the planar portion and joined to the front face of a solid semi-disc, said solid semi-disc fixedly coupled to back portion of the movement case by means of a plurality of screws to prevent the rotation thereof and each bump means having a central perforation including an internal thread, and wherein the securing means for each adjusting guide comprising: a screw, passing trough the semicircular slot of an adjusting guide and threaded inside the central perforation of the bump means, thus applying a pressure to an adjusting guide but not restricting the rotation thereof.

10. A gauge having adjustable activating means according to claim 1, wherein the sensor means comprising a switch connected to said alarm.

11. A gauge having adjustable activating means according to claim 1, wherein the sensor means comprising a switch connected to an electronic controller which can send signals representative of corrective actions or adjustments to a controlled device in order to return sensed conditions to a "tolerance value region".

* * * * *